US006357404B1

(12) United States Patent
Deeg

(10) Patent No.: US 6,357,404 B1
(45) Date of Patent: Mar. 19, 2002

(54) VALVE CONTROL SYSTEM AND METHOD FOR AN INTERNAL-COMBUSTION ENGINE

(75) Inventor: Hans-Peter Deeg, Rielingshausen (DE)

(73) Assignee: Dr. Ing. h.c.F. Porsche AG, Weissach (DE)

( * ) Notice: Subject to any disclaimer, the term of this patent is extended or adjusted under 35 U.S.C. 154(b) by 0 days.

(21) Appl. No.: 09/721,675

(22) Filed: Nov. 27, 2000

(30) Foreign Application Priority Data

Nov. 27, 1999 (DE) ..... 199 57 157

(51) Int. Cl.[7] ..... F02D 13/02

(52) U.S. Cl. ..... 123/90.15; 123/90.16; 123/90.17; 123/198 D; 73/116; 73/117.3

(58) Field of Search ..... 123/90.15, 90.16, 123/90.17, 90.18, 90.48, 90.6, 198 D; 73/116, 117.2, 117.3, 118.1; 74/567, 568 R

(56) References Cited

U.S. PATENT DOCUMENTS 5,031,583 A 7/1991 Konno ..... 123/90.16
5,287,830 A 2/1994 Dopson et al. ..... 123/90.16
5,549,080 A * 8/1996 Uchikawa ..... 123/90.16
5,924,397 A * 7/1999 Moriya et al. ..... 123/90.18
6,006,707 A * 12/1999 Ito ..... 123/90.15
6,101,993 A * 8/2000 Lewis et al. ..... 123/90.17
6,135,078 A * 10/2000 Doi et al. ..... 123/90.18

FOREIGN PATENT DOCUMENTS

EP 0 515 520 12/1994

* cited by examiner

*Primary Examiner*—Weilun Lo
(74) *Attorney, Agent, or Firm*—Crowell & Moring LLP

(57) ABSTRACT

A control system is provided for an internal-combustion engine of a piston design having several cylinders. At least one camshaft actuates valves for charge cycle control in a combustion space of the internal-combustion engine. Some of the valves, as a function of at least one parameter of the internal-combustion engine, are constructed to be adjustable with respect to the lift by switching elements interacting with the camshaft. For checking the functioning of one or several of the switching elements, measuring values of the camshaft are detected and, in the event of defined deviations, are indicated as a function signal.

16 Claims, 4 Drawing Sheets

VALVE CONTROL SYSTEM AND METHOD FOR AN INTERNAL-COMBUSTION ENGINE

BACKGROUND OF THE INVENTION

This application claims the priority of German Patent Application number 199 57 157.0, filed in Germany, Nov. 27, 1999, the disclosure of which is expressly incorporated by reference herein.

The invention relates to a control system and method for an internal-combustion engine.

A known valve control system of an internal combustion engine—U.S. Pat. No. 5,031,583—comprises a camshaft with cams of a different profile which actuate an inlet valve or an outlet valve. Between the cams and the valves, rocker levers are provided by means of which, using coupling elements, the lift of the respective valve can be influenced. Furthermore, the camshaft is provided with a phase regulator by means of which the valve timing can be changed. It is a disadvantage of this construction that no measures are taken for monitoring the function of the coupling elements.

This analogously applies to switching elements—European Patent Document EP 0515520 (corresponding U.S. Pat. No. 5,287,830)—constructed as switching cups interacting with valves of a control system, by means of which, in conjunction with different cams of a camshaft, the lift of the valves can be varied.

It is an object of the invention to take measures in a valve control system for internal-combustion engines in order to be able to check the function of switching elements which are used for adjusting the lift of valves causing the charge cycle control.

According to the invention, this object is achieved by providing a control system for an internal-combustion engine of a piston construction, having several cylinders, said control system comprising at least one camshaft operable to actuate valves for charge cycle control in a combustion space of the internal-combustion engine, at least one valve, as a function of at least one parameter of the internal-combustion engine, being constructed to be adjustable with respect to the lift by switching elements interacting with the camshaft, wherein, for checking the functioning of the switching elements, measuring values (Mw) of the camshaft (inlet camshaft 11) are detected and, in the event of defined deviations from respective defined values, are displayed as a function signal (Fs).

Additional features of preferred embodiments of the invention are described herein and in the claims.

Principal advantages achieved by means of the invention are that, during the operation of an internal-combustion engine utilizing the invention, a malfunctioning of a switching element of the control system, which may result in mechanical damage, can be determined as a function signal. This can take place by using corresponding devices for customer service testing or by vehicle-fixed diagnostic devices, such as OBD (=on-board diagnosis). Torsional vibration signals of a camshaft of the control system are suitable as measuring values for this purpose because the torsional vibration course on a camshaft changes significantly at different valve lifts because of different valve forces. This results in the fact that the torsional vibration peaks of the camshaft will reach a uniform level when all switching elements of the control system according to their function. In the event of possible disturbances of one or several switching elements, a changed torsional vibration course—alternating large and small vibration peaks—occurs on the camshaft which can be detected by way of Hall generators, induction generators, optical generators or the like. For generating the function signal, the parameters of the switching condition of a phase control of a camshaft, of the switching condition of the valve lift switching, of the rotational speed of the camshaft, and of the oil temperature of the lubricating oil of the internal-combustion engine can also be used.

Other objects, advantages and novel features of the present invention will become apparent from the following detailed description of the invention when considered in conjunction with the accompanying drawings.

DETAILED DESCRIPTION OF THE DRAWINGS

Figure 1:
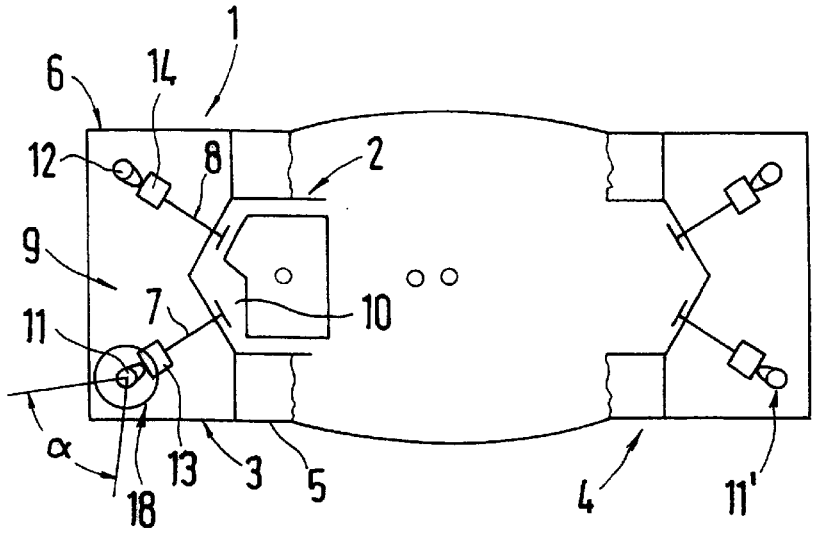
FIG. 1 is a schematic view of an internal-combustion engine with a control system constructed according to a preferred embodiment of the invention.
Figure 2:
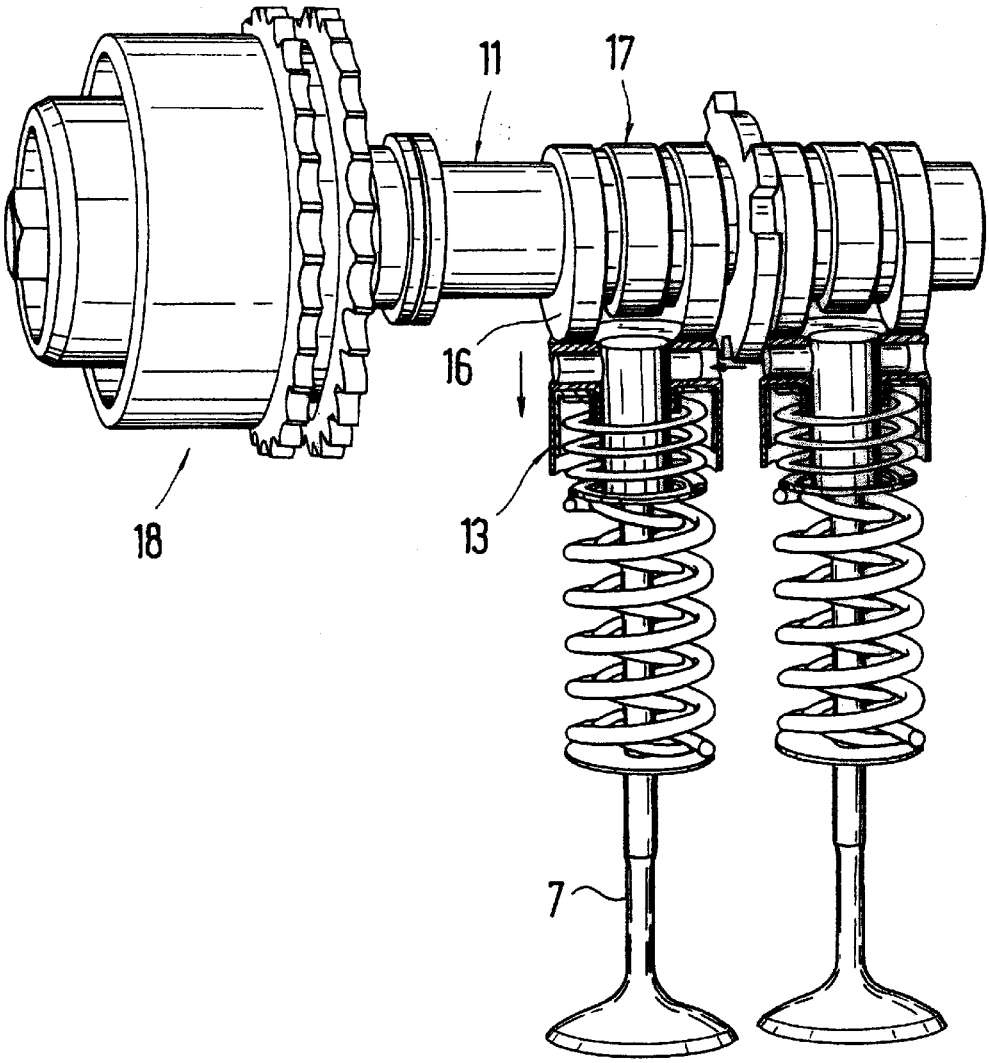
FIG. 2 is a partial view of the control system with a switching element and a camshaft adjuster.

An internal-combustion engine 1 comprises several cylinders 2 and opposed cylinder banks 3 and 4 in which the cylinders are provided. Each cylinder bank 3 has a cylinder housing 5 and a cylinder head 6. For each cylinder 2, the cylinder head 6 is equipped with at least one inlet valve 7 and one outlet valve 8 which are components of a control system 9 and are used for controlling the charge cycle in a combustion space 10 of the respective cylinder 2. The actuating of the inlet valves 7 and of the outlet valves 8 is carried out by means of an inlet camshaft 11 and an outlet camshaft 12, bucket tappets 13, 14 being arranged between the camshafts 11 and 12 and the valves 7 and 8. At least the bucket tappets 13 which interact with the inlet valves 7 are constructed as switching elements 15 by means of which the lift of the inlet valves 7 can be varied or switched. For this purpose, different cams 16 and 17 for each inlet valve 7 are mounted on the inlet camshaft 11—FIG. 2—. In this case, cam 16 causes a maximal lift of the inlet valve; cam 17 causes a reduced lift. Furthermore, the inlet camshaft 11 is provided with a camshaft adjuster 18 by means of which its relative rotating position can be changed at the angle a with respect to the outlet camshaft 12. This can influence the timing of the inlet valves 7 and the outlet valves 8.

Figure 6:
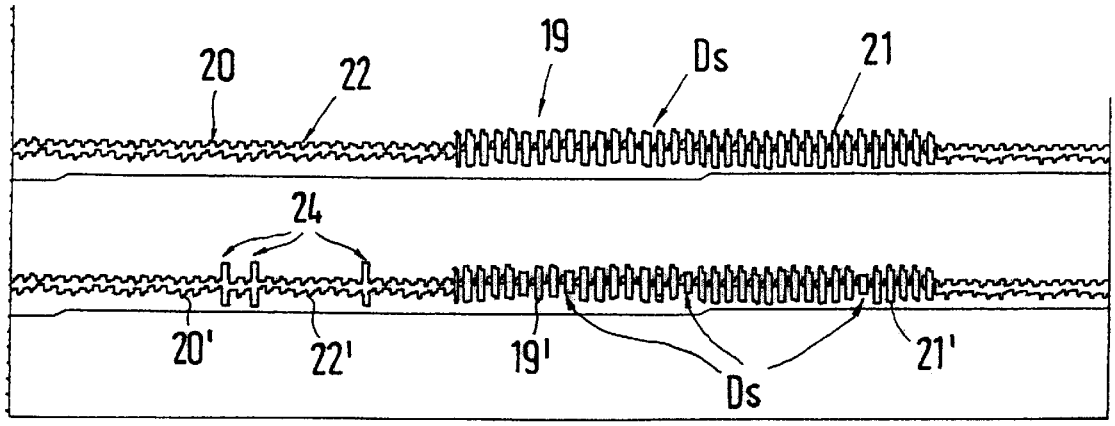
FIG. 6 is a diagram which reflects torsional vibrations of a camshaft.

The change of the rotating position of the inlet camshaft 11 and the lift change-over of the switching elements 15 takes place, for example, as a function of the rotational speed and of the load—accelerator position of the internal-combustion engine 1. For checking the functioning of the switching elements 15, that is, whether the latter have the same switching position—maximal lift or reduced lift—, torsional vibration signals Ds of the inlet camshaft 11 are detected as measuring values Mw and, in the case of defined deviations, are indicated as function signal Fs. The measuring values Mw resulting from the torsional vibration signals Ds are illustrated in FIG. 6. Thus, the vibration line 19 reflects a vibration course with the line sections 20 and 21 which is appropriate for the functioning. Line section 20 is obtained when the switching elements 15 operate with a reduced lift; line section 21 is obtained when the switching elements operate with a maximal lift. The torsional vibration peaks 22 and 23 of the line sections 20 and 21 have an essentially uniform course, which means that the switching elements 15 are operating according to the constructive design, thus in a proper manner. In contrast, vibration line 19' in line section 20' as well as in line section 211 has torsional vibration peaks 24 and 25 which deviate from the normal torsional vibration peaks 22' and 23'. The latter are the result of functional disturbances of one or several switching elements 15. The torsional vibration signals or measuring values Mw are measured by means of a Hall generator 26 which is assigned to the inlet camshaft 11. However, an induction generator, optical generator, or the like is also suitable for this purpose according to other contemplated preferred embodiments of the invention.

Figure 3:
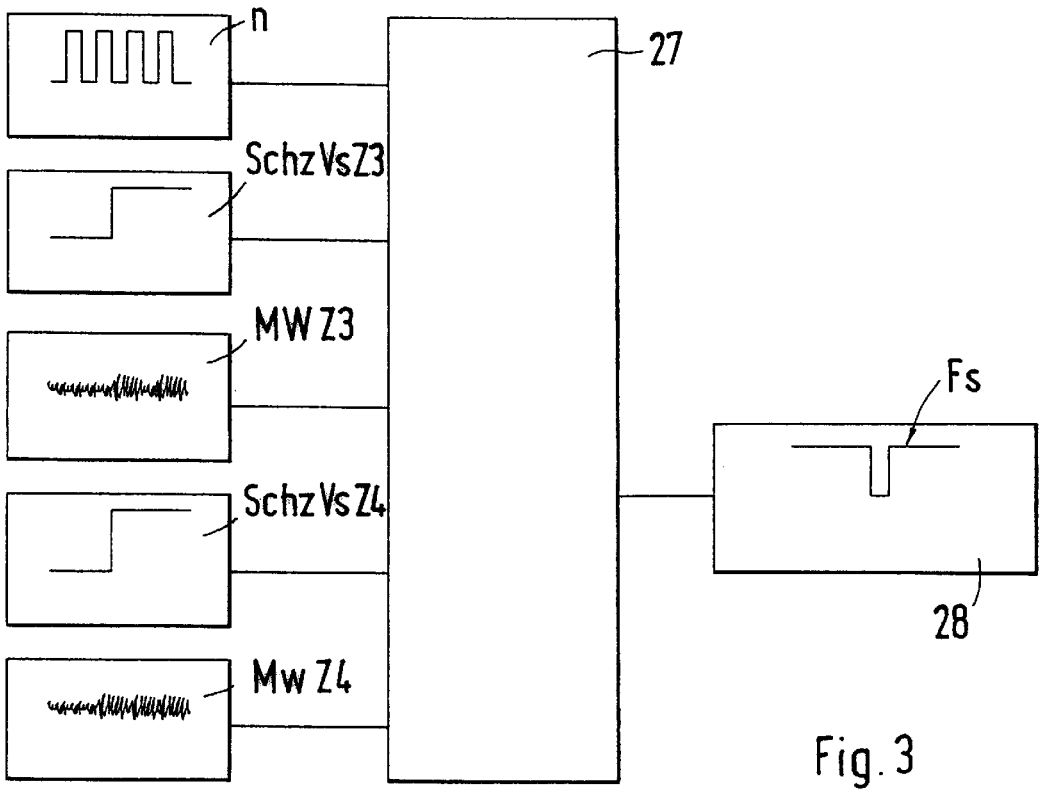
FIG. 3 is a first diagram which illustrates the generating of the function signal according to the invention.

FIG. 3 illustrates an embodiment for generating the function signal Fs. In this case, the rotational speed n of the internal-combustion engine, the switching condition SchzVsZ3 of the valve lift switching of the cylinder bank 3, the measuring values MwZ3 of the inlet camshaft 11 of the cylinder bank 3, the switching condition SchzVsZ4 of the valve lift switching of the cylinder bank 4 and the measuring values MwZ4 of the inlet camshaft 11' of the cylinder bank 4 are supplied to an electronic analyzing system 27. These data are processed in the electronic analyzing system 27. In the event that disturbances occur at the switching elements 15, these disturbances are displayed in an indicating device 28 as the function signal Fs.

Figure 4:
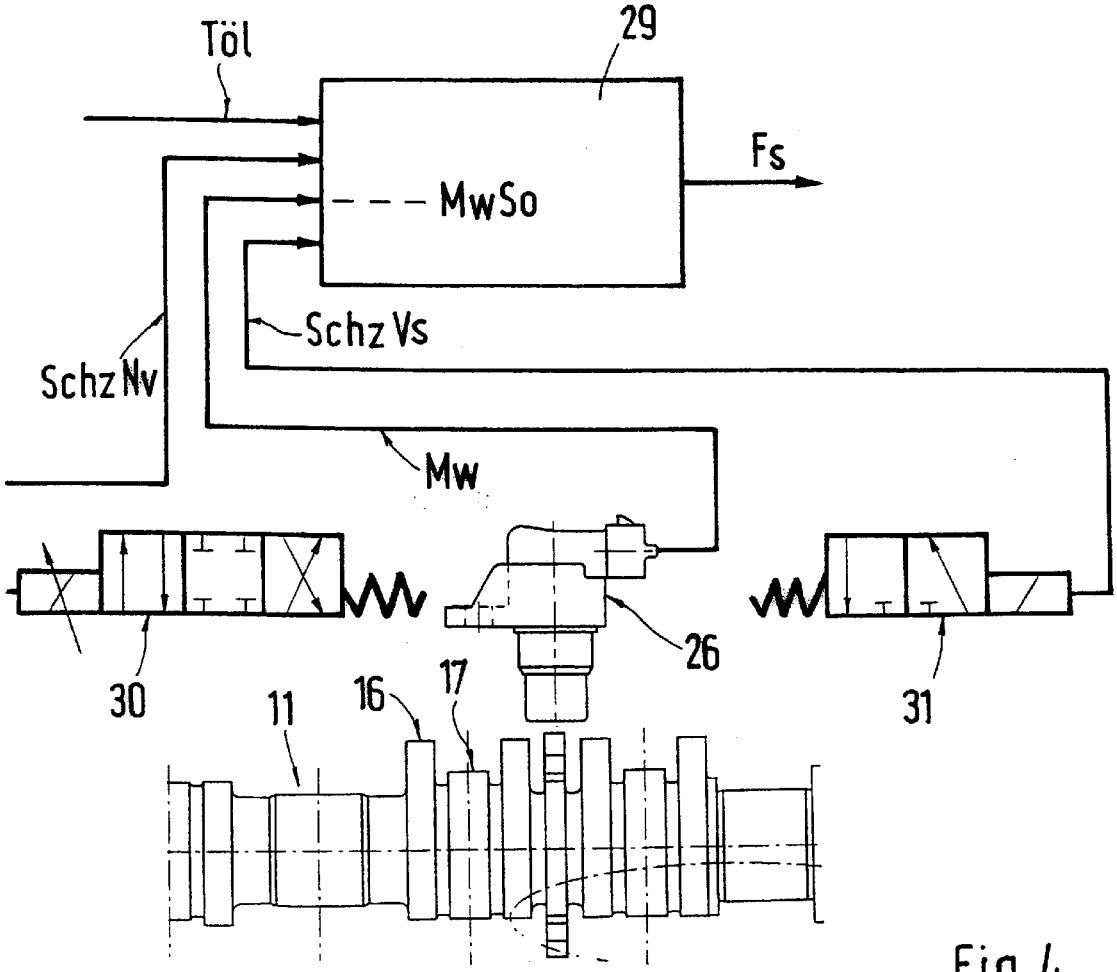
FIG. 4 is a second diagram corresponding to FIG. 3.

FIG. 4 shows a diagram in which the function signal Fs is formed in an electronic analyzing system 29 by the parameters switching condition SchzNv of the camshaft adjuster 18, switching condition SchVs of the valve lift switching, measuring values Mw of the inlet camshaft 11 and oil temperature Töl of the internal-combustion engine 1. In this case, the switching condition SchzNv of the camshaft adjuster 18 is measured at a first solenoid valve; the switching condition SchzVs of the valve lift switching is measured at a second solenoid valve 31. The measuring values Mw of the inlet camshaft 18 are measured by the Hall generator 26 which interacts with the inlet camshaft 11. In the electronic analyzing system 29, the measuring values Mw are compared with the desired measuring values MwSo and form the basis of the function signal Fs.

Figure 5:
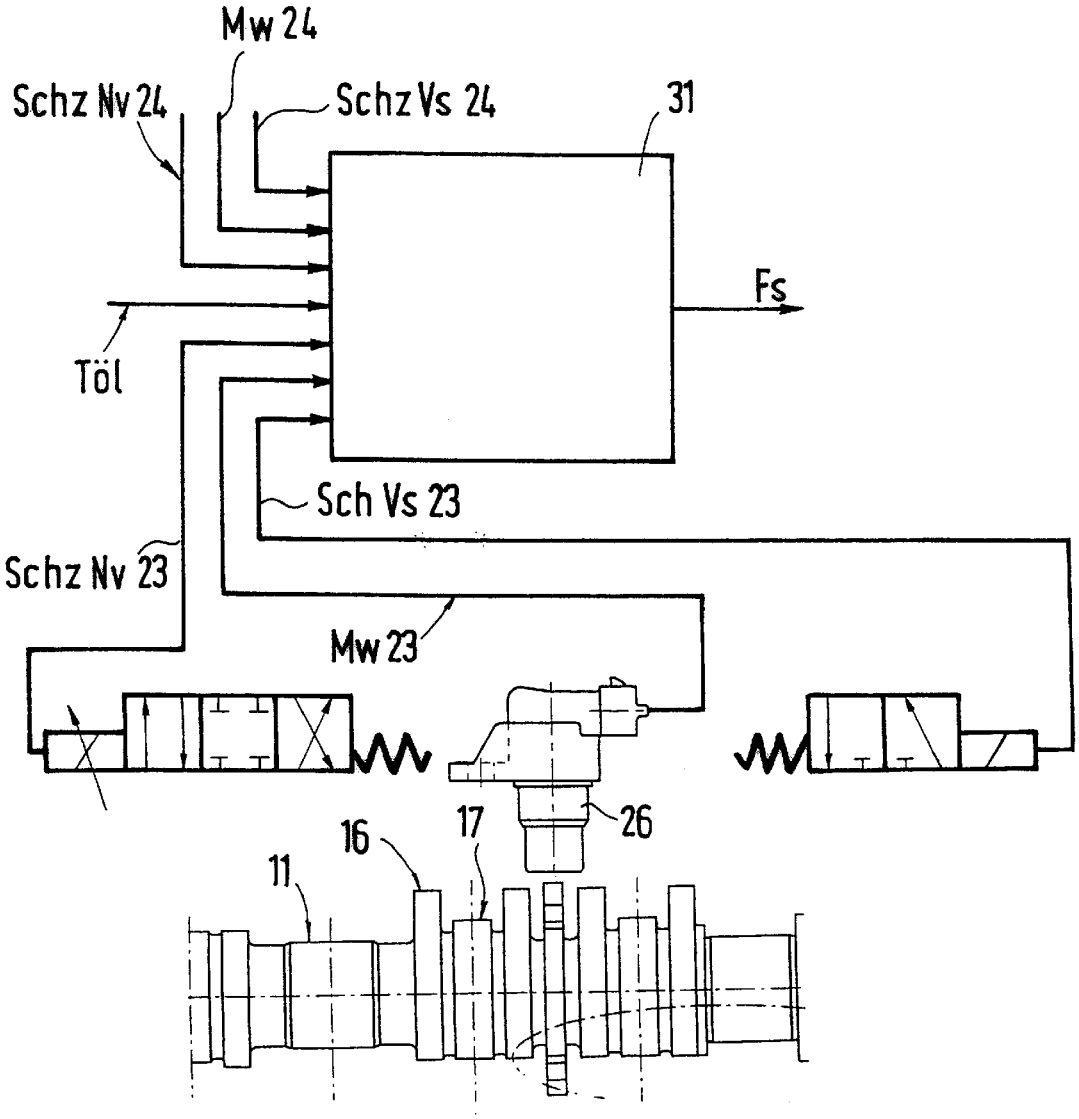
FIG. 5 is a third diagram corresponding to FIG. 3.

According to FIG. 5, the inlet camshafts 11 and 11' of the cylinder banks 3 and 4 are used for forming the function signal Fs; that is, if the measuring values NwZ3 of the cylinder bank 3 and the measuring values MwZ4 of the cylinder bank 4 are identical, the switching elements 15 are operating within the defined range. In the event of deviations, the electronic analyzing system 31 generates the function signal Fs. For this purpose, the following parameters are supplied to the electronic analyzing system 31: Switching condition SchzNvZ3 and SchzNvZ4 of the camshaft adjusters 18 of the cylinder banks 3 and 4, switching condition SchzVsZ3 and SchzVsZ4 of the valve lift switching of the cylinder banks 3 and 4, measuring values MwZ3 and MwZ4 of the inlet camshafts 11, 11' of the cylinder banks 3 and 4 and the oil temperature Töl of the internal-combustion engine 1.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. Control system for an internal-combustion engine of a piston construction, having several cylinders, said control system comprising at least one camshaft operable to actuate valves for charge cycle control in a combustion space of the internal-combustion engine, at least one valve, as a function of at least one parameter of the internal-combustion engine, being constructed to be adjustable with respect to the lift by switching elements interacting with the camshaft, wherein, for checking the functioning of the switching elements, measuring values (Mw) of the camshaft are detected and, in the event of defined deviations from respective defined values, are displayed as a function signal (Fs).

2. Control system according to claim 1, wherein torsional vibration signals (Ds) of the camshaft are used as the measuring values (Mw).

3. Control system according to claim 1, wherein the function signal (Fs) is generated by the parameters:

switching condition (SchzNv) of a camshaft adjuster, switching condition (SchzVs) of the valve lift switching, measuring values (Mw) of the camshaft, and oil temperature (Töl) of the lubricating oil of the internal-combustion engine.

4. Control system according to claim 2, wherein the function signal (Fs) is generated by the parameters:

switching condition (SchzNv) of a camshaft adjuster, switching condition (SchzVs) of the valve lift switching, measuring values (Mw) of the camshaft, and oil temperature (Töl) of the lubricating oil of the internal-combustion engine.

5. Control system according to claim 3, wherein the parameter switching condition (SchzNv) of the camshaft is measured at a solenoid valve of the camshaft adjuster.

6. Control system according to claim 4, wherein the parameter switching condition (SchzNv) of the camshaft is measured at a solenoid valve of the camshaft adjuster.

7. Control system according to claim 3, wherein the parameter, switching condition (SchzVs) of the valve lift switching, is measured at a solenoid valve of the switching element.

8. Control system according to claim 4, wherein the parameter, switching condition (SchzVs) of the valve lift switching, is measured at a solenoid valve of the switching element.

9. Control system according to claim 3, wherein the parameters of measuring values (Mw) of the camshaft are measured at a Hall generator, an induction generator, or an optical generator for the camshaft.

10. Control system according to claim 4, wherein the parameters of measuring values (Mw) of the camshaft are measured at a Hall generator, an induction generator, or an optical generator for the camshaft.

11. Control system according to claim 3, wherein the parameters:

switching condition (SchzNv) of the camshaft adjuster, switching condition (SchzVs) of the valve lift switching, measuring values (Mw) of the camshaft, and oil temperature (Töl) of the internal-combustion engine are processed in an electronic analyzing system to generate the function signal (Fs).

12. Control system according to claim 5, wherein the parameters:

switching condition (SchzNv) of the camshaft adjuster, switching condition (SchzVs) of the valve lift switching, measuring values (Mw) of the camshaft, and oil temperature (Töl) of the internal-combustion engine are processed in an electronic analyzing system to generate the function signal (Fs).

13. Control system according to claim 7, wherein the parameters:

switching condition (SchzNv) of the camshaft adjuster, switching condition (SchzVs) of the valve lift switching, measuring values (Mw) of the camshaft, and oil temperature (Töl) of the internal-combustion engine are processed in an electronic analyzing system to generate the function signal (Fs).

14. Control system according to claim 9, wherein the parameters:

switching condition (SchzNv) of the camshaft adjuster, switching condition (SchzVs) of the valve lift switching, measuring values (Mw) of the camshaft, and oil temperature (Töl) of the internal-combustion engine are processed in an electronic analyzing system to generate the function signal (Fs).

15. Control system according to claim 1, wherein the function signal (Fs) is generated by way of instruments which are installed in the motor vehicle and/or are constructed to be independent thereof.

16. Method for checking the functioning of one or several switching elements of a control system for an internal-combustion engine, comprising:

detecting a change of a torsional vibration course of a camshaft using a Hall generator, transmitting the detection results to an electronic analyzing system, and indicating a functional abnormality of at least one switching element on an indicating device.

* * * * *